US006267491B1

(12) United States Patent
Parrigin

(10) Patent No.: US 6,267,491 B1
(45) Date of Patent: Jul. 31, 2001

(54) LENS RETENTION MEANS FOR VEHICLE LAMP ASSEMBLY

(75) Inventor: Albert Parrigin, Columbus, IN (US)

(73) Assignee: Grote Industries, Inc., Madison, IN (US)

( * ) Notice: Subject to any disclaimer, the term of this patent is extended or adjusted under 35 U.S.C. 154(b) by 0 days.

(21) Appl. No.: 09/426,264

(22) Filed: Oct. 25, 1999

(51) Int. Cl.[7] ..... F21V 29/00

(52) U.S. Cl. ..... 362/546; 362/267; 362/455; 362/310; 362/362; 362/153; 362/153.1; 362/520

(58) Field of Search ..... 362/267, 455, 362/310, 362, 153, 153.1, 546, 520

(56) References Cited

U.S. PATENT DOCUMENTS

| | | | |
|---|---|---|---|
| 698,999 | 4/1902 | Nicholson . | |
| 870,535 | 11/1907 | Bausch . | |
| 1,768,747 | 7/1930 | Darling . | |
| 1,781,729 | 11/1930 | Major . | |
| 2,095,657 | 10/1937 | Burgess | 240/41.5 |
| 2,499,555 | 3/1950 | Wronkowski | 240/46.59 |
| 2,525,977 | 10/1950 | Tinnerman | 240/151 |
| 2,943,187 | 6/1960 | Schwartz | 240/151 |
| 3,422,260 | 1/1969 | Hedgewick | 240/41.55 |
| 3,597,606 | 8/1971 | Abendroth | 240/41.3 |
| 3,651,321 | 3/1972 | Magi et al. | 241/151 |
| 3,863,306 | 2/1975 | Duchatellier | 24/252 B |
| 4,410,931 | 10/1983 | DeCandia et al. | 362/267 |
| 4,437,142 | 3/1984 | Donato et al. | 362/226 |
| 4,543,623 * | 9/1985 | Ehret | 362/267 |
| 4,779,180 | 10/1988 | Ruiz | 362/433 |
| 5,119,282 * | 6/1992 | Meyer et al. | 362/306 |
| 5,156,454 * | 10/1992 | White | 362/153 |
| 5,477,441 | 12/1995 | Budnovitch et al. | 362/362 |
| 5,632,551 | 5/1997 | Roney et al. | 362/249 |
| 6,068,384 * | 5/2000 | Tyson et al. | 362/153.1 |
| 6,106,134 * | 8/2000 | Bomas | 362/153.1 |

FOREIGN PATENT DOCUMENTS 369786 4/1932 (GB) .

* cited by examiner

*Primary Examiner*—Stephen Husar
*Assistant Examiner*—Anabel M Ton
(74) *Attorney, Agent, or Firm*—Woodard, Emhardt, Naughton, Moriarty & McNett

(57) ABSTRACT

This invention discloses a lamp housing adaptable for snapped-in installation of the lens member. The interior wall of the housing is provided with an annular step and integrally formed raised projections which together form slots for receiving the peripheral edge of the lens member. The raised projections are shaped to facilitate the installation and retention of the lens. The lens member, made of resilient material, is of sufficient flexibility that it can be pressed past the raised projections and be lodged in the slots. A gasket is interposed between the lens member and the annular step. The slots are so dimensioned that the raised projections press against the lens and the gasket to retain the lens in the slots and additionally seal the interior of the housing from the outside environment.

11 Claims, 2 Drawing Sheets

LENS RETENTION MEANS FOR VEHICLE LAMP ASSEMBLY

FIELD OF THE INVENTION

The present invention relates generally to means for retaining a lens on the housing of a lamp assembly, and more specifically to a vehicle lamp assembly having a housing that is adaptable for snap-in installation and retention of the lens element.

BACKGROUND OF THE INVENTION

Lamp assemblies are widely used in motor vehicles. Such assemblies generally include a lamp housing defining an inner space within which a light emitting unit, such as a light bulb, is placed and a lens member interposed between the light emitting unit and the exterior of the housing. It is desirable for the lens member to be mounted so that it can be removed easily for replacement of the light or other periodic maintenance, and so that when reassembled, it will seal the interior of the housing against weather and debris.

Prior art lamp assemblies utilize a variety of attachment methods and schemes to mount the lens members onto lamp housings. Most of the attachment methods employ mechanical means such as retaining rings, clips and spring arms (U.S. Pat. Nos. 870,535, No. 2,943, 187, No. 2,499,555 and No. 4,779,180). Such assemblies are relatively expensive to manufacture, since they involve multiple separate parts that must be assembled together. Other attachment methods involve gluing the parts together with cement or epoxy (U.S. Pat. No. 5,632,551). Cement and epoxy mounting are also undesirable because of the permanent nature of the attachment and the prolonged production cycle time due to the curing requirements. U.S. Pat. No. 3,651,321 to Magi and No. 5,119,282 to Meyer each disclose a lamp assembly with a snap-in lens member. Magi's design involves many precision parts; and additionally, once the lens is snapped-in, it is difficult to dissemble. Meyer's design is relatively simple, involving the use of an annular groove on the lamp housing to retain the lens element. Meyer's design, however, requires the lamp housing to be made of a resilient or flexible material and additionally, makes no provision for protecting the interior environment of the lamp assembly.

It is a principal object of the present invention to provide a system for mounting a lens member onto a lamp housing such that the lens member can be easily installed and removed.

It is another object of this invention to provide a snap-in installation of the lens member directly onto the lamp housing without the need for separate installation of additional parts.

It is a further object of the present invention to provide a weatherproof lamp assembly which includes a sealing member for the protection of the interior of the lamp assembly.

SUMMARY OF THE INVENTION

According to the present invention, these and other objects and advantages are achieved in a lamp assembly comprising a housing and a lens member retained within the housing. The housing has a base, side walls and an opening; together, they define a three dimensional space within which a light emitting unit is disposed. The side walls include a plurality of annular step portions, one or which serves as a support for the lens member after its installation. A plurality of integrally formed, inwardly protruding raised projections are disposed circumferentially along the upper portion of the side walls above the annular step portions. These raised projections are shaped to allow easy passage easily in the forward direction for installation, and more difficult passage in the reverse direction for removal. The raised projections in cooperation with the annular step portion form slots for receiving the lens member and a sealing gasket. The lens member is composed of a resilient material, is sufficiently flexible that it can be pushed past the raised projections and lodged securely in the slots and held circumferentially on the annular step portion of the housing. The slots are dimensioned such that the lower surfaces of the raised projections press against the lens and firmly secure the lens and the gasket against the annular step portion of the housing and additionally hermetically seals the interior space of housing from the outside environment.

BRIEF DESCRIPTION OF THE DRAWING

For a better understanding of the present invention together with other and further objects, advantages and capabilities thereof, reference is made to the accompanying figures which are incorporated herein by reference and in which.

DETAILED DESCRIPTION OF THE PREFERRED EMBODIMENT

Figure 1:
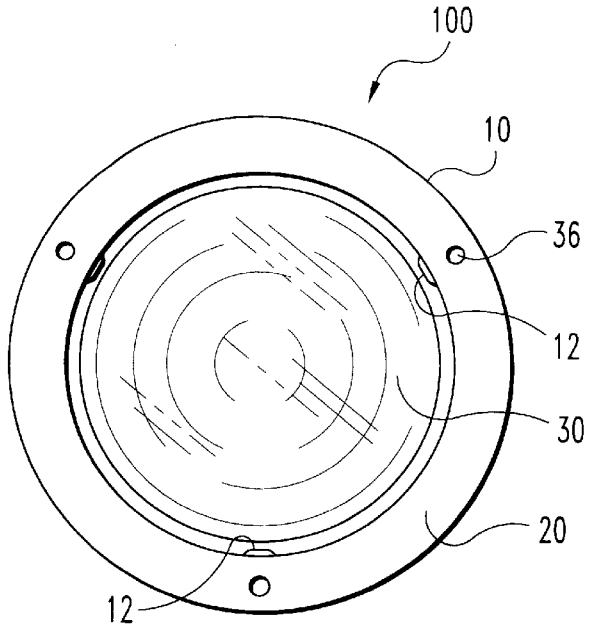
FIG. 1 is a top plan view of a lamp housing showing the lens member in place.
Figure 2:
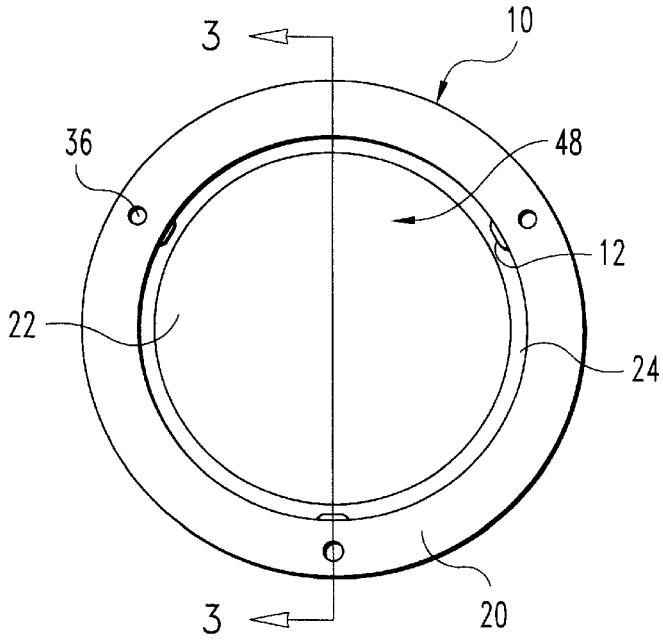
FIG. 2 is a top plan view of lamp housing with the lens member removed.

For the purpose of promoting an understanding of the principles of the invention, reference will now be made to the embodiment illustrated in the drawings and specific language will be used to describe the same. It will nevertheless be understood that no limitation of the scope of the invention is thereby intended, such as alterations and further modifications in the illustrated device, and such further applications of the principles of the invention as illustrated therein being contemplated as would normally occur to one skilled in the art to which the invention relates.

Referring to FIGS. 1–4, a lamp assembly 100 comprises a housing 10 defining a three-dimensional inner space 48 within which a light emitting unit 32, such as a light bulb or light emitting diode array, is placed, and a lens 30 removably disposed within the housing 10.

Figure 3:
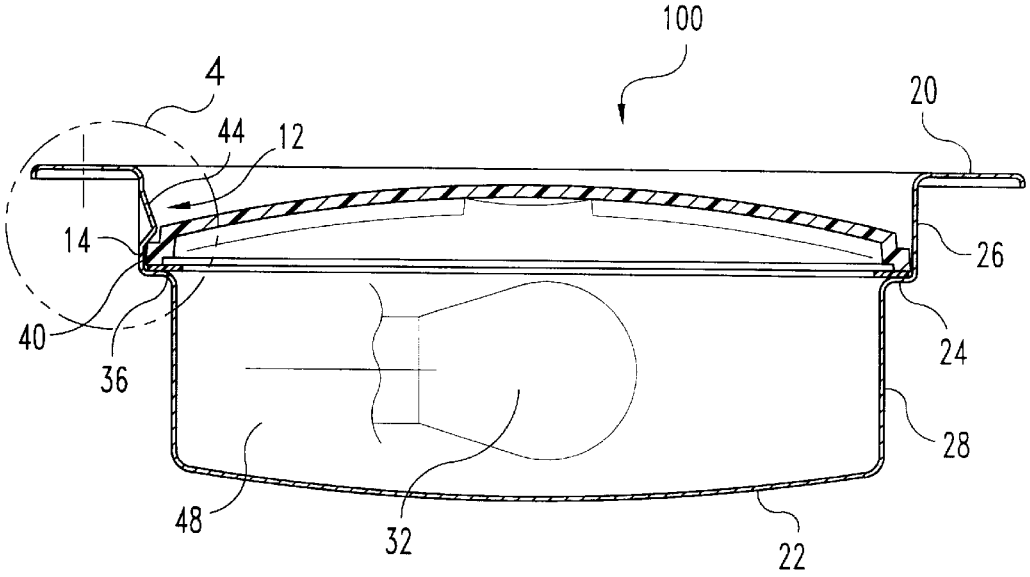
FIG. 3 is a side elevational, cross-sectional view, along line 3—3 in FIG. 1, of the lamp housing with the lens member in place.

In the embodiment as illustrated in FIG. 3, housing 10, preferably formed of a single piece of material, forms a general bowl-shape. The bowl configuration has a bottom 22 and a parallel outer flange 20 integrally connected by the upper cylindrical wall 26 and lower cylindrical wall 28. Upper cylindrical wall 26 is integrally connected to lower cylindrical wall 28 through annular step portion 24. Annular step portion 24 is to provide positional support to lens 30. Upper cylindrical wall 26 provides a recessed wall for the lens 30 to protect against external breakage force. Outer flange 20 integrally connected to and circumscribes the upper cylindrical wall 28 has a plurality of holes 36 for receiving fasteners disposed therein. Outer flange 20 provides a sturdy and convenient mechanical mechanism for mounting the lamp assembly into a vehicle.

Bottom 22, being relatively flat, is designed for receiving light emitting units 32 such as a circuit board containing light emitting diodes. However, it is to be understood that the shape of housing 10 may be modified to accommodate other light emitting sources, such as incandescent bulbs.

Disposed equally-spaced circumferentially around the upper cylindrical wall 26 is a plurality of inwardly protruding raised projections 12. The raised projections 12 are v-shaped with the apex pointing into the internal space 48 of housing 10. The upper portion 44 of the raised projection 12 forms a gentle incline with the upper cylindrical wall 26. The gentle incline allows easy passage of the lens member during installation. The lower portion 14 of the raised projection 12 is shorter than upper portion 44 and forms a steeper incline with the upper cylindrical wall 26. The steeper incline discourages accidental dislodgment of the lens member 30 and hence better retention. The angle of the incline, however, still allows de-installation or removal of the lens member 30 when an adequate prying force is applied. The lower portion 14 of the raised projection 12 forms a c-shaped slot 16 with the annular step portion 24. The c-shape slot 16 is dimensioned to receive the peripheral edge 40 of lens 30 and gasket 34 and is also dimensioned so that the lower portion 14 of raised projection 12 can press against lens 30 and firmly secure the lens 30 and gasket 34 against the annular step portion 24 of housing 10.

In this embodiment, three raised projections are employed; and they are equally spaced around the periphery of upper cylinder wall 26, such that they appear to form the apices of an equilateral triangle. The number of raised projection 12 may vary depending on design needs, or the size or shape of lens 30, for balancing retention and easy installation and removal of lens 30.

Figure 4:
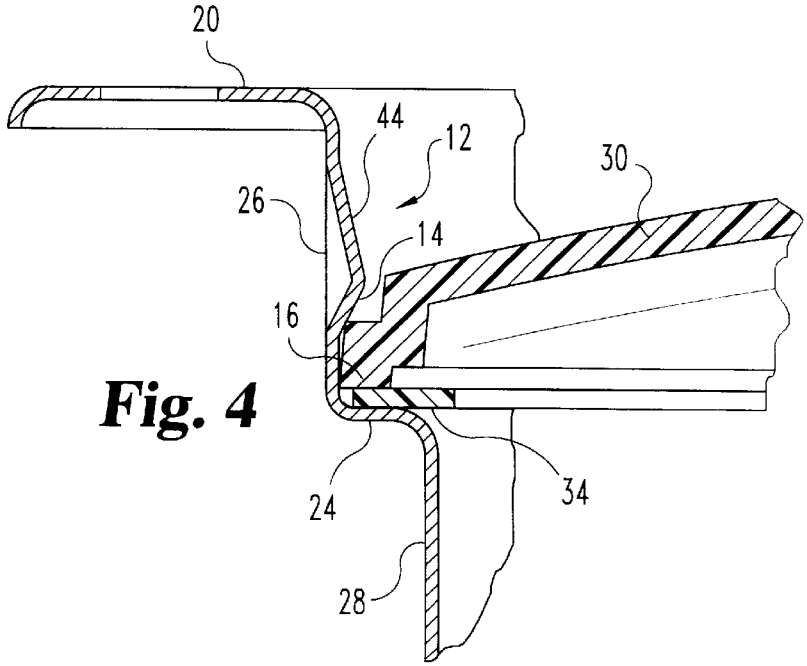
FIG. 4 is an enlarged, side elevational, cross sectional view of a raised projection portion shown in FIG. 3.

As shown in FIGS. 3–4, a gasket 34 is interposed between the lens 30 and the annular step portion 24. The gasket 34 provides a watertight environment for the interior space 48 of the assembled lamp assemblies. Gasket 34 is preferably made of silicon rubber, but other suitable gasket materials may be used.

Preferably, housing 10 is made of metal, such as anodized aluminum or painted steel, which has adequate structural rigidity, impact strength and corrosion resisting properties. Other materials, such as some high impact plastics, which possess the desired properties, may also be used. Furthermore, a housing made of a resilient material such that the housing 10 would yield when the lens 30 is being installed would also be preferred.

Lens 30, having a peripheral edge 40, is sized to cover the housing front area circumscribed by step portion 24. Lens 30 preferably made of a material which imparts adequate resilience and flexibility to the lens 30, enabling it to be pressed past the raised projections 12 without being damaged. A material, which in addition to resilience, also possesses a high resistance to mechanical damage and to ultraviolet light degradation would be more preferred. In this embodiment, lens 30 is formed of ACRYLIC® resin. Other tinted or clear plastics, such as polycarbonate, possessing the light transmission and resilient qualities described above may also be used. Furthermore, lens 30 may be made of a highly rigid material, such as glass, when lens 30 is used in combination with a housing 10 made of a resilient material.

The lamp assembly 100 may be assembled by first placing a gasket on the annular step portion 24. The lens member 30 is then held in place in the opening into space 48 and pressure is applied until the lens 30 snaps behind the three raised projections 12 such that the peripheral edge 40 of lens 30 lodges securely in the c-shaped slots 16. The bottom portion 14 of raised projection 12 presses against lens 30 and firmly secure the lens 30 against the gasket 34 and the annular step portion 24 of housing 10, and additionally allows the gasket 34 to seal the interior space 48 of housing 10 from the outside environment. It should also be pointed out that when lamp 100 is assembled, lens 30 is completely recessed within housing 10. The upper cylindrical wall 26 of housing 10 thus acts to protect lens 30 from damage due to contact by external forces. For maintenance, e.g. cleaning and relamping, the lens 30 may be removed by prying under the lens with a thin object. The light assembly 100 may be re-assembled after maintenance as described above.

While the invention has been illustrated and described in detail in the drawings and foregoing description, the same is to be considered as illustrative and not restrictive in character, it being understood that only one of the preferred embodiments has been shown and described and that all changes and modifications that come within the spirit of the invention are desired to be protected.

What is claimed is:

1. A vehicle lamp assembly comprising:

a housing defining a three dimensional inner space for receiving a light emitting unit;

a lens disposed within said housing;

said housing having a base and side wall, wherein said side wall incorporates at least one annular step portion and a plurality of inward protruding, raised projections circumferentially disposed above said at least one annular step portion;

said raised projections being shaped to allow passage of said lens during installation and disassembly;

said plurality of raised projections cooperating with said at least one annular step portion to form a plurality of slots to permit said lens after passage over said plurality of raised projections to rest on said at least one annular step portion and be retained within said plurality of slots.

2. The lamp assembly of claim 1, further including a gasket being interposed between said lens and said at least one annular step portion whereby said gasket provides a watertight seal for the interior of said housing.

3. The lamp assembly of claim 1, wherein said raised projections are integrally formed from said side wall of said housing.

4. The lamp assembly of claim 1, wherein said raised projections are v-shaped, having top and bottom portions meeting above an apex, said apex pointing inwardly into said inner space of said housing.

5. The raised projections of claim 4, wherein said top portion is longer than said bottom portion thereby forming a gentle incline with said side wall to allow easy passage of said lens member; and wherein said bottom portion is shorter than said top portion, thereby forming a steep incline with said side wall to discourage accidental dislodgment of said lens, yet allowing removal of said lens.

6. The lamp assembly of claim 1, wherein said plurality of raised projections is three.

7. The lamp assembly of claim 6, wherein said three raised projections are arranged circumferentially around said side walls at the apices of a substantially equilateral triangle.

8. The lamp assembly of claim 1, further including an outward extending flange integrally connected to the top of said housing whereby providing mechanical mechanism to mount the lamp assembly into a vehicle.

9. The lamp assembly of claim 1 wherein said lens is completely recessed within said housing.

10. A snap-in lens retaining means for a lamp assembly comprising:

a housing, a lens having a peripheral edge, a gasket interposed between said lens and said housing; wherein, said housing having a wall and an opening for receiving said lens, said wall including an upper portion and a lower portion connected by an annular step portion, wherein a plurality of integrally formed, inwardly protruding, raised projections are disposed circumferentially about said upper wall above said annular step, said lens being sufficiently flexible to allow passage over said projections and dimensioned to rest on said annular step portion, said raised projections forcibly holding said lens within said housing against said gasket.

11. A snap-in lens retaining means for a lamp assembly of claim 9, wherein said raised projections of claim 10 form a v-shaped member with the apex of said v-shaped member pointing inward, said member having upper and lower portions; said upper portion being longer than said lower portion to facilitate easy installation and retention of said lens.

* * * * *